United States Patent [19]

Murray

[11] Patent Number: 5,000,615

[45] Date of Patent: Mar. 19, 1991

[54] SYSTEM FOR RECLAIMING AND RELAYING PAVEMENT IN PLACE

[75] Inventor: Stuart W. Murray, Edmond, Okla.

[73] Assignee: CMI Corporation, Oklahoma City, Okla.

[21] Appl. No.: 462,687

[22] Filed: Jan. 9, 1990

[51] Int. Cl.[5] ..... E01C 7/32

[52] U.S. Cl. ..... 404/75; 404/81; 404/90; 404/91; 404/92; 404/101; 299/36

[58] Field of Search ..... 299/39; 404/91, 75, 404/76, 77, 78, 79, 80, 81, 83, 90, 92, 72, 73

[56] References Cited

U.S. PATENT DOCUMENTS

| | | | |
|---|---|---|---|
| 1,938,755 | 12/1933 | Swearingen | 94/43 |
| 2,181,320 | 11/1939 | Flynn | 94/39 |
| 2,394,017 | 2/1946 | Seaman | 94/44 |
| 2,424,459 | 7/1947 | Hettelsater | 94/40 |
| 2,885,934 | 5/1959 | Gardner | 94/40 |
| 2,917,395 | 12/1959 | Csanyi | 106/122 |
| 3,224,347 | 12/1965 | Seaman | 94/40 |
| 3,361,042 | 1/1968 | Cutler | 94/23 |
| 3,598,027 | 8/1971 | Swisher | 94/22 |
| 3,843,274 | 10/1974 | Gutman et al. | 404/91 |
| 4,139,318 | 2/1979 | Jakob et al. | 299/39 |
| 4,172,679 | 10/1979 | Wirtgen | 404/90 |
| 4,236,675 | 12/1980 | Bladykas | 404/75 |
| 4,256,414 | 3/1981 | Milligan | 404/79 |

OTHER PUBLICATIONS

PR-500FL Roto-Mill Pavement Profiler, CMI Corp., 1990.

CMI News, CMI Corp., Spring 1989, pp. 10-12 & 18-20.

CMI News, CMI Corp., Winter, 1989, pp. 4-5 & 20-21.

"Foamed Asphalt" by Csanyi, technical bulletin No. 240, American Roadbuilders Association, 1959.

"Use of Foamed Asphalt in Soil Stabilization" by R. M. Nady and L. H. Csanyi, pp. 452-467.

*Primary Examiner*—Ramon S. Britts

*Assistant Examiner*—Roger J. Schoeppel

*Attorney, Agent, or Firm*—Dunlap, Codding, Peterson & Lee

[57] ABSTRACT

A system for removing and relaying asphaltic concrete pavement using a planer pulling a laydown machine and pushing equipment for (a) screening the cuttings produced by the planer, and (b) mixing the screened cutting, with a suitable binder, wherein the mix is conveyed back to the laydown machine.

10 Claims, 3 Drawing Sheets

SYSTEM FOR RECLAIMING AND RELAYING PAVEMENT IN PLACE

CROSS REFERENCE TO RELATED APPLICATION

The subject matter of this application is related to the subject matter disclosed in co-pending application Ser. No. 06/691,498 filed Jan. 14, 1985, and entitled APPARATUS AND METHOD FOR PRODUCING COLD MIX ASPHALT.

BRIEF SUMMARY OF THE INVENTION

1. Field of the Invention

This invention relates to improvements in techniques for removing and relaying pavement, and more particularly, but not by way of limitation, asphaltic concrete pavement.

2. Background of the Invention

For many years the most popular technique for reclaiming deteriorated asphaltic concrete roads and streets has been to either partially or completely remove the pavement material, as by milling, and then combining the removed pavement material with additional virgin materials in a hot mix process. The hot mix asphalt plant is normally located at some distance from the point at which the pavement material is removed, thereby necessitating substantial trucking and other manufacturing costs. Up to the present time, a totally acceptable technique for removing all or a portion of the pavement material and then relaying the removed pavement material into a new slab in a single operation has not been found.

DETAILED DESCRIPTION OF THE DRAWING

Figure 1A:
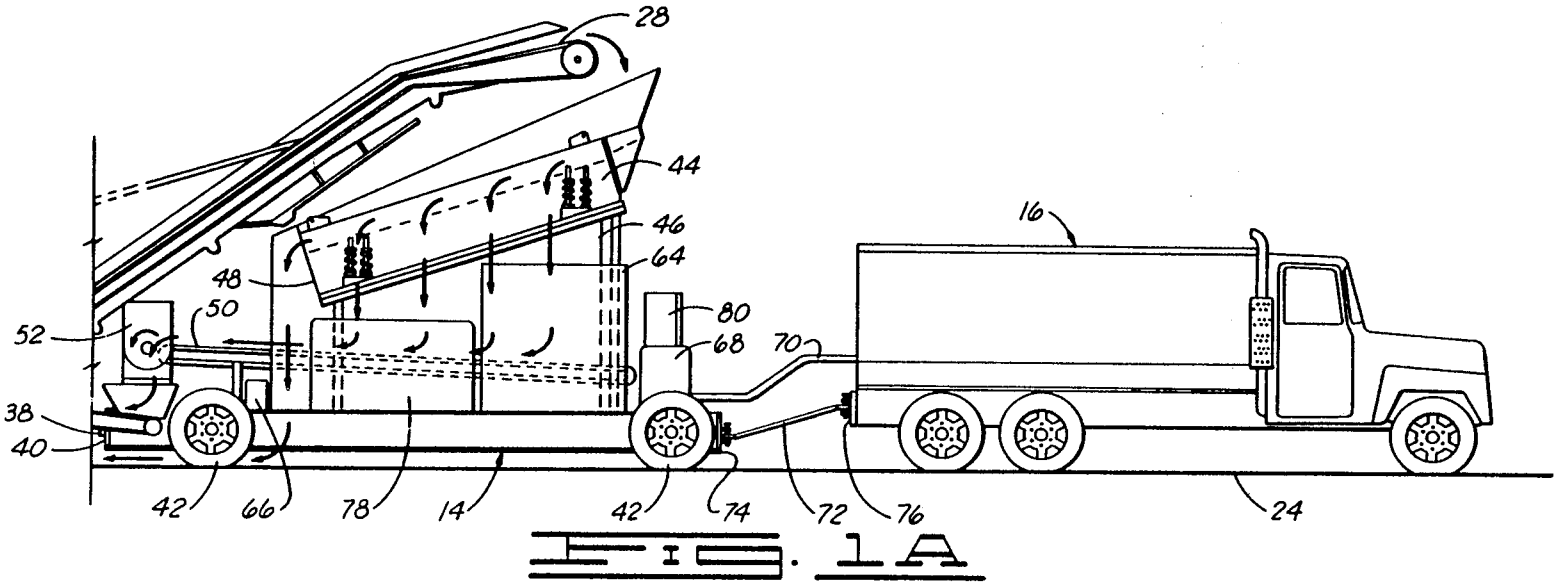
FIGS. 1A and 1B are schematic side views of typical equipment which may be employed in this invention, with the structure shown in FIG. 1A being the forward portion of the train of equipment and the equipment shown in FIG. 1B being the trailing portion of such equipment.
Figure 1B:
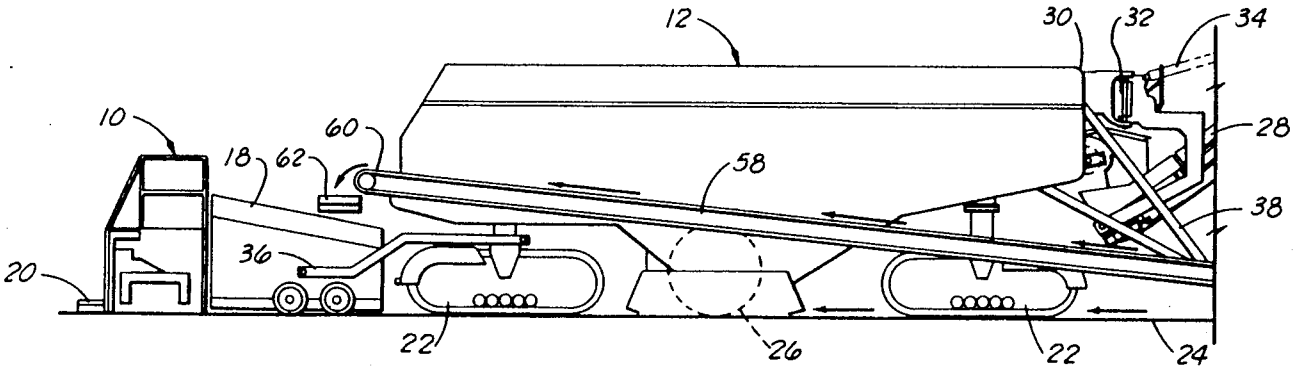

As previously indicated, this invention employs a train of equipment adapted to move along the path of an existing, deteriorated pavement, remove at least a portion of such pavement and relay the removed material into a new slab or an overlay on the existing slab. Starting at the rear end of such a train, as shown in FIG. 1B, the equipment generally comprises a paving apparatus 10, a milling machine 12, what may be called a screening cart 14 (FIG. 1A) and a binder supply truck 16.

In one form of this invention, the paving apparatus 10 may be a conventional, self propelled laydown machine, but in use in the present train, is not operated as a self propelled machine. The apparatus 10 has a hopper 18 in the forward portion thereof to receive the material to be formed into a slab, along with a suitable screed 20 for forming the slab.

The milling machine 12 is a self propelled machine supported by suitable tracks 22 for movement along the surface of the existing slab 24. Such a milling machine utilizes a cutter 26, usually located generally in the central portion of the machine, which extends transversely across the slab 24 and is employed to remove all or a portion of the slab 24 as the machine 12 moves forwardly, from left to right as shown in FIG. 1B. The milling machine 12 contemplated by this invention provides the necessary mechanism (not shown) for conveying the removed pavement material forwardly in the machine onto a forwardly extending conveyor 28 extending from the forward end 30 of the milling machine. Although the conveyor 28 is normally mounted on the forward end 30 of the machine 12 by a pivotal connection 32 and supported by truss work 34 for swinging movement to the left and to the right, the conveyor 28 is maintained in a forwardly extending direction during use with the present invention.

The conveyor 28 is positioned to receive the pavement material removed by the machine 12 and convey such removed pavement material, which will be in various particle sizes, upwardly and forwardly from the machine 12. A milling machine of the type suitable for this invention is known as the PR500FL made by CMI Corporation of Oklahoma City, Okla.

Suitable towing arms 36 extend from the paver 10 forwardly into connection with the milling machine 12, such that the milling machine 12 will tow the paver 10 along the path of the pavement 24. A suitable pushing mechanism 38 extends forwardly from the front of the milling machine 12 for engaging the rear end 40 of the cart 14, thereby pushing the cart 14 along the path of the pavement 24.

The cart 14 may be of any desired construction utilizing supporting wheels 42 or the like by means of which the cart is rolled along the path of the pavement 24. A suitable screen 44 is mounted on top of a surge bin 46 in turn supported on the cart 14. The screen 44 is slanted, such that removed pavement material having a particle size too large for movement through the screen 14 will be directed downwardly off of the rear end 48 of the screen onto the surface of the pavement 24 between the rear wheels 42 of the cart 14.

Figure 2:
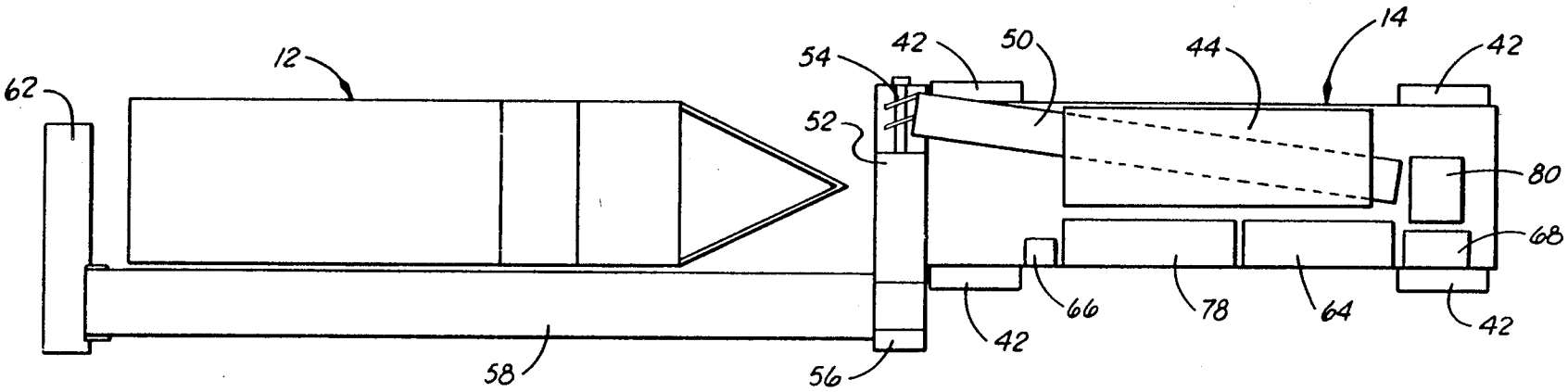
FIG. 2 is a schematic plan view of a portion of the equipment shown in FIGS. 1A and 1B; the leading and trailing pieces of equipment, not being shown.

A conveyor 50 extends through the surge bin 46 to form what may be considered a live bottom for the surge bin and extends rearwardly from the surge bin to the input of a continuous mixer 52. The conveyor 50 is positioned in the surge bin 46 such that the smaller particle sizes of the removed pavement material that fall through the screen 44 will be directed rearwardly into the mixer 52. The mixer 52 is suitably supported on the cart 14 to extend transversely across the cart as illustrated in both FIGS. 1A and 2. The mixer 52 is preferably of the type which utilizes a heated, single screw 54 for mixing the particulated removed pavement material with a binder in the same manner as in a continuous mix hot mix asphalt plant. The discharge end 56 of the mixer 52 is positioned above another conveyor 58 supported from the milling machine 12 and extending rearwardly along side the milling machine 12. The discharge end 60 of the conveyor 58 is positioned to dump materials conveyed by the conveyor 58 onto a chute 62 which extends transversely across the rear of the milling machine 12 to direct such mixed materials into the hopper 18 of the paver 10.

The preferred binder to be used with the removed pavement material in the mixer 52 is an emulsion. A heated emulsion holding tank 64 is suitably supported on the cart 14 and forms a supply for an emulsion pump 66 also mounted on the cart 14. The emulsion pump 66 is connected by suitable conduits (not shown) to the tank 64 and to the inlet end of the mixer 52 for controlling the flow of emulsion into the mixer 52 in accordance with the volume of removed pavement material being fed to the mixer 52 by the conveyor 50 in a manner well known in the art.

The emulsion holding tank 64 is supplied with emulsion from the binder supply truck 16 through use of an unloading pump 68. The pump 68 is connected to the truck 16 by conduit 70 and to the holding tank 64 by another conduit (not shown), such that the holding tank 64 can be resupplied with emulsion when and as necessary. As shown in FIG. 1A, a suitable pushing assembly 72 extends from the front end 74 of the cart 14 to the rear end 76 of the truck 16, such that the truck 16 is also pushed along the path of the pavement 24 by the milling machine 12.

The cart 14 also would normally support a suitable generator 78 along side the surge bin 46 and a operator's control panel 80 on the forward portion of the cart.

In operation, the train of equipment previously described is arranged at the beginning end of the job on the pavement 24. As previously indicated, the existing pavement 24 may be totally removed and replaced, or only a layer of the pavement 24 may be removed and replaced pursuant to the present invention.

As the train of equipment moves forwardly along the path of the pavement 24, the milling machine 12 removes the desired portion of the pavement material in such a way that the removed pavement material is in various particle sizes ranging from, say, minus 200 mesh up to, for example, chunks larger than 2 inches, in a typical operation. The removed pavement material is moved forwardly in the milling machine 12 and loaded onto the conveyor 28, such that all of the removed pavement material is dumped onto the screen 44. The openings in the screen 44 are sized to provide a maximum particle size it is desired to utilize in the mixing operation. Those particles larger than the openings in the screen 44 are discharged onto the pavement surface 24 between the rear wheels 42 of the cart 14, such that they will be picked up by the milling machine 12. Thus, these larger particles will be further broken down by the cutter 26 of the milling machine 12 and reduced in particle size, such that they can be passed through the screen 44 on the next cycle.

The removed pavement material having a particle size such that the particles were passed through the screen 44 fall into the surge bin 46. The surge bin 46 functions to provide a uniform supply of removed pavement material to the conveyor 50, such that the volume of removed pavement material fed into the mixer 52 can be maintained at least fairly constant. In this way, the volume of emulsion supplied by the pump 66 into the mixer 52 can be more easily controlled. In the alternative, the conveyor may be provided with an electronic weighing system for controlling the emulsion supply in a manner well known in the art.

The mixer 52 thoroughly mixes the removed pavement material and binder to provide a cold mix product being discharged onto the conveyor 58 extending rearwardly along side the milling machine 12. This cold mix material is directed by the chute 62 into the hopper 18 of the paver 10. Thus, the cold mix material is relayed onto that portion of the pavement 24 existing after passage of the milling machine 12, or onto the subgrade below where the paving material was previously located. In any event, the cold mix material is laid into a slab to form a new pavement.

Figure 3:
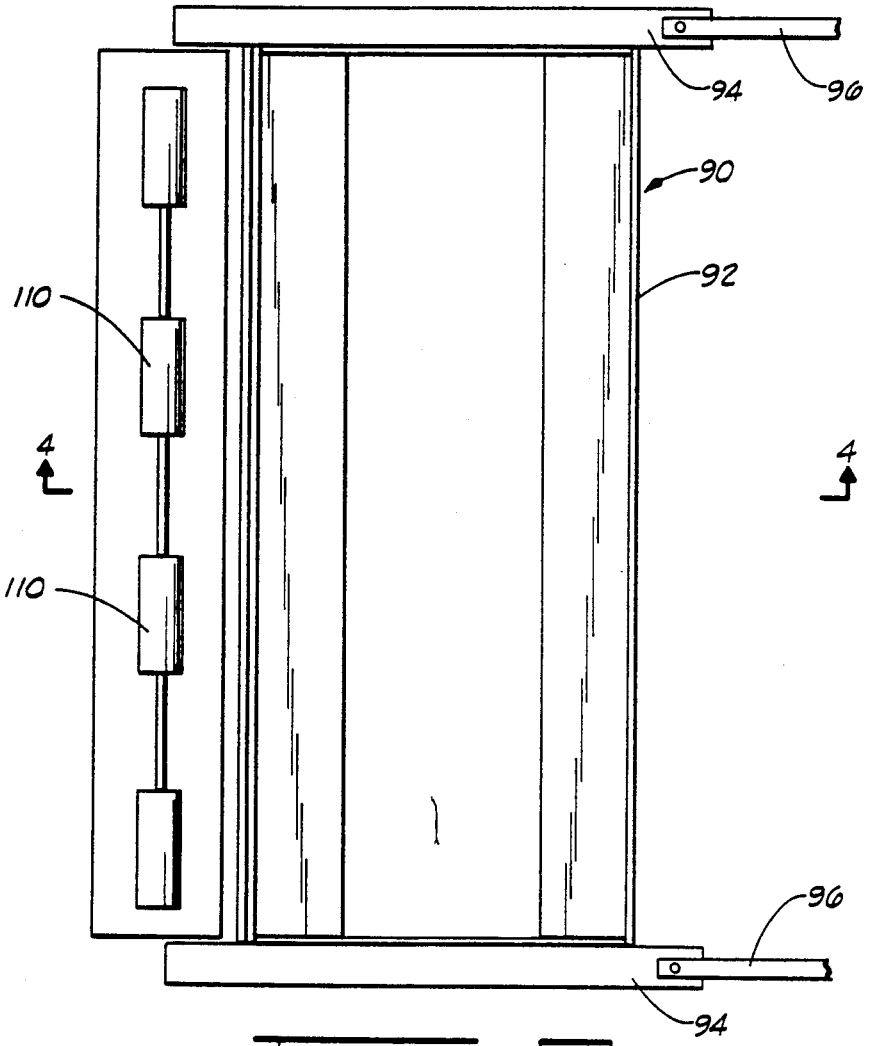
FIG. 3 is a schematic plan view of an alternate paving apparatus which may be used in the train of equipment of this invention.
Figure 4:
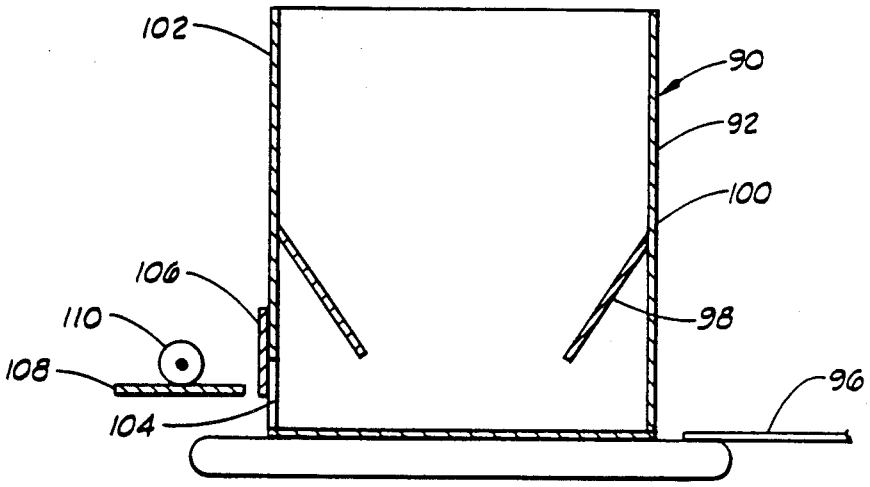
FIG. 4 is a schematic cross sectional view through the apparatus shown in FIG. 3 as taken along lines 4—4 of FIG. 3.

In lieu of the conventional laydown machine 10, the present invention also contemplates the use of a more simplified paver 90 illustrated in FIGS. 3 and 4. The paver apparatus 90 generally comprises a hopper 92 generally rectangular in shape and having a width generally corresponding to the width of the desired slab to be laid. For example, when the present invention is being used in an operation where only one lane is being worked upon at a time and the remaining lane or lanes are kept open for traffic flow, the width of the hopper 92 may be in correspondence with the width of the lane being reworked, or even less, if desired. The hopper 92 is supported on suitable skids 94 at the opposite sides thereof, with the skids 94 connected by towing arms 96 to the milling machine 12, whereby the paver apparatus 90 will be towed by the milling machine in such a position that the reclaimed material being directed rearwordly by the conveyor 58 will be directed by the device 62 into the hopper 92.

Baffles 98 are provided on the front and the rear walls 100 and 102 of the hopper 92. The baffles 98 are positioned in the lower portion of the hopper 92 to control the flow of reclaimed pavement material into the bottom of the hopper. Preferably, the baffles 98 extend at about 55 degrees from the vertical to provide some support for the reclaimed pavement material in the hopper 92. An opening 104 is provided in the lower portion of a rear wall 102 of the hopper 92, by means of which the reclaimed pavement material can flow out the rear of the hopper onto the surface on which the new slab is being laid. A suitable strike-off plate 106 is adjustably supported on the rear wall 102 of the hopper, by means of which the volume of material being discharged through the opening 104 may be controlled. Also, a suitable screed 108 is supported from the rear wall 102 of the hopper for smoothing and controlling the depth of pavement material being laid. Suitable vibrators 110 are provided on the screed 108 in the normal fashion.

Changes may be made in the combination and arrangement of parts or elements as heretofore set forth in the specification and shown in the drawings without departing from the spirit and scope of the invention as defined in the following claims.

What is claimed is:

1. A system for reclaiming and relaying pavement in place, comprising:

a self-propelled milling machine for removing the pavement material as the machine moves along the path of the pavement;

a cart in front of the milling machine in a position to be pushed along the path of the pavement by the milling machine;

means for conveying milled pavement material removed by the milling machine to above the cart;

a screen on the cart positioned to receive the milled pavement material, direct large particle size material which will not pass the screen onto the pavement ahead of the milling machine and direct the smaller milled material passing the screen in a second direction; and means for mixing the smaller milled material with a binder and relaying the mixed material behind the milling machine.

2. A system as defined in claim 1 wherein the last mentioned means includes:

a surge bin on the cart positioned to receive and temporarily store the small material passing the screen.

3. A system as defined in claim 2 wherein the last-mentioned means includes a conveyor forming a live bottom in the surge bin.

4. A system as defined in claim 1 wherein the binder is an emulsion.

5. A system as defined in claim 3 wherein the last-mentioned means further includes a continuous mixer on the cart.

6. A system as defined in claim 5 wherein the last-mentioned means further includes a conveyor extending along side the milling machine from the mixer to the rear of the milling machine.

7. A system as defined in claim 6 wherein the last-mentioned means further includes a paver connected to the milling machine in a position to be pulled by the milling machine, the means for directing mixed material from the last-mentioned conveyor to the paver.

8. A system as defined in claim 4 characterized further to include an emulsion supply truck positioned in front of the cart in a position to be pushed along the pavement by the milling machine.

9. A system as defined in claim 8 characterized further to include a continuous mixer on the cart positioned to receive the smaller material and the emulsion and mix the same together.

10. A system as defined in claim 9 characterized further to include an emulsion holding tank on the cart connected to be supplied emulsion from the truck, and an emulsion pump on the cart connected to the holding tank for supplying emulsion to the mixer in accordance with the volume of said smaller milled material being fed to the mixer.

* * * * *